US008251370B2

(12) United States Patent
Guarnieri et al.

(10) Patent No.: US 8,251,370 B2
(45) Date of Patent: Aug. 28, 2012

(54) GAME MACHINE

(75) Inventors: Jack Guarnieri, Jackson, NJ (US); Drew Maniscalco, Odessa, FL (US)

(73) Assignee: Jack Guarnieri Service Co., Inc., Lakewood, NJ (US)

( * ) Notice: Subject to any disclaimer, the term of this patent is extended or adjusted under 35 U.S.C. 154(b) by 8 days.

(21) Appl. No.: 12/944,354

(22) Filed: Nov. 11, 2010

(65) Prior Publication Data

US 2011/0115163 A1 May 19, 2011

Related U.S. Application Data

(60) Provisional application No. 61/261,401, filed on Nov. 16, 2009.

(51) Int. Cl.
*A63F 9/30* (2006.01)

(52) U.S. Cl. ..... 273/448; 273/447

(58) Field of Classification Search ..... 273/447, 273/448; 463/1, 40, 42
See application file for complete search history.

(56) References Cited

U.S. PATENT DOCUMENTS

| | | | | |
|---|---|---|---|---|
| 4,778,176 | A * | 10/1988 | Shoemaker, Jr. | 273/448 |
| 5,271,628 | A * | 12/1993 | Okada | 273/448 |
| 5,533,726 | A | 7/1996 | Nordman et al. | |
| 5,855,374 | A * | 1/1999 | Shoemaker, Jr. | 273/447 |
| 6,336,636 | B1 | 1/2002 | Smart | |
| 6,454,261 | B2 * | 9/2002 | Ohira | 273/140 |
| 6,588,760 | B2 * | 7/2003 | Carter et al. | 273/448 |
| 7,168,702 | B1 * | 1/2007 | Shoemaker | 273/138.1 |
| 7,192,342 | B2 * | 3/2007 | Shoemaker, Jr. | 463/7 |
| 2002/0067002 | A1 * | 6/2002 | Yoshida et al. | 273/447 |
| 2003/0090065 | A1 * | 5/2003 | Carter et al. | 273/447 |
| 2006/0170164 | A1 * | 8/2006 | Watanabe | 273/447 |
| 2011/0115163 | A1 * | 5/2011 | Guarnieri et al. | 273/448 |

FOREIGN PATENT DOCUMENTS

JP 2000070542 A * 3/2000

* cited by examiner

*Primary Examiner* — Raleigh W. Chiu
(74) *Attorney, Agent, or Firm* — Graham Curtin, PA

(57) ABSTRACT

A game machine comprises a housing, a user access panel having a controller, a money acceptor, a rotating field having a surface for receiving a plurality of objects situated thereon, a retriever that is movable along a track that is supported by the housing for enabling movement of the retriever relative to the rotating field, an object receiving area, and an outlet for access to the object received within the object receiving area.

18 Claims, 5 Drawing Sheets

GAME MACHINE

CROSS-REFERENCE TO RELATED APPLICATIONS

This application claims the benefit of U.S. Application 61/261,401 filed Nov. 16, 2009, which is incorporated herein by reference in its entirety.

FIELD OF THE INVENTION

The present invention relates to arcade game machines in general, and more specifically to a retrieval and redemption game that is aesthetically pleasing and exciting to play.

BACKGROUND

Arcade claw-type games haven't changed much throughout the years. Traditional claws include mechanical prong-type grabs that are lowered onto a prize, such as a plush toy, for acquisition of the prize and for delivery of the acquired prize to a prize drop or chute for delivery to the player. Another type of claw uses a magnet that is lowered onto a prize and will grab the prize that is aligned directly under the magnet. The prize includes a magnetic element that is attracted to the magnetic claw, which claw can be a magnet or an electromagnet, for example. In either case, however, the focus of the game is directed to the prize to be acquired, and the claw structure or the game field tends to fade into the background. While claw games typically have aesthetically pleasing environments, the claw itself is typically not structurally incorporated into the theme of the game.

SUMMARY

A game machine comprises a housing, a user access panel having a controller, a money acceptor, a rotating field having a surface for receiving a plurality of objects situated thereon, a retriever that is movable along a track that is supported by the housing for enabling movement of the retriever relative to the rotating field, an object receiving area, and an outlet for access to the object received within the object receiving area. The retriever incorporates a structure having a consistent theme with the rotating field and the game environment.

DETAILED DESCRIPTION OF THE PREFERRED EMBODIMENTS

Figure 1:
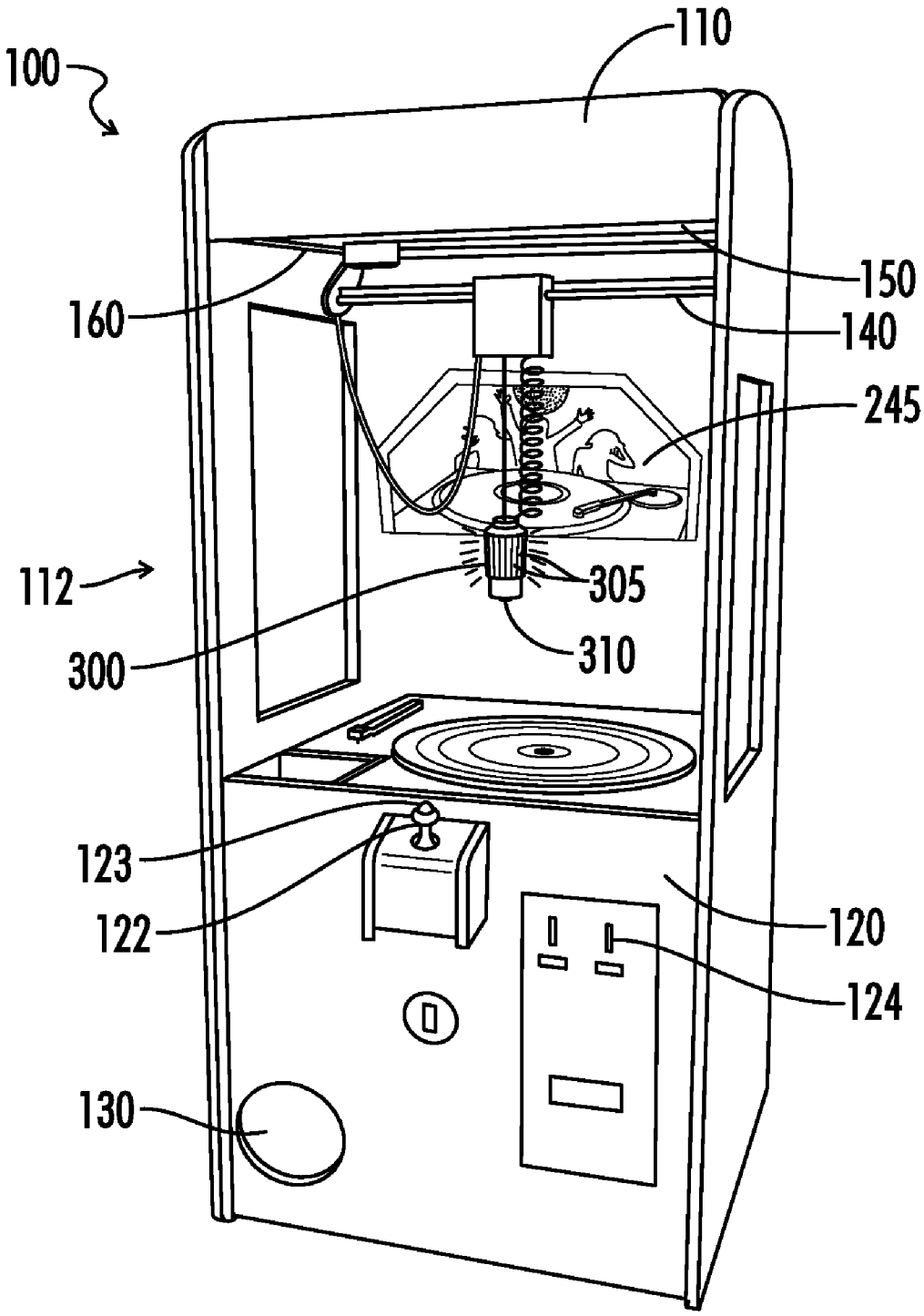
FIG. 1 is one embodiment of a game machine of the present invention.
Figure 2:
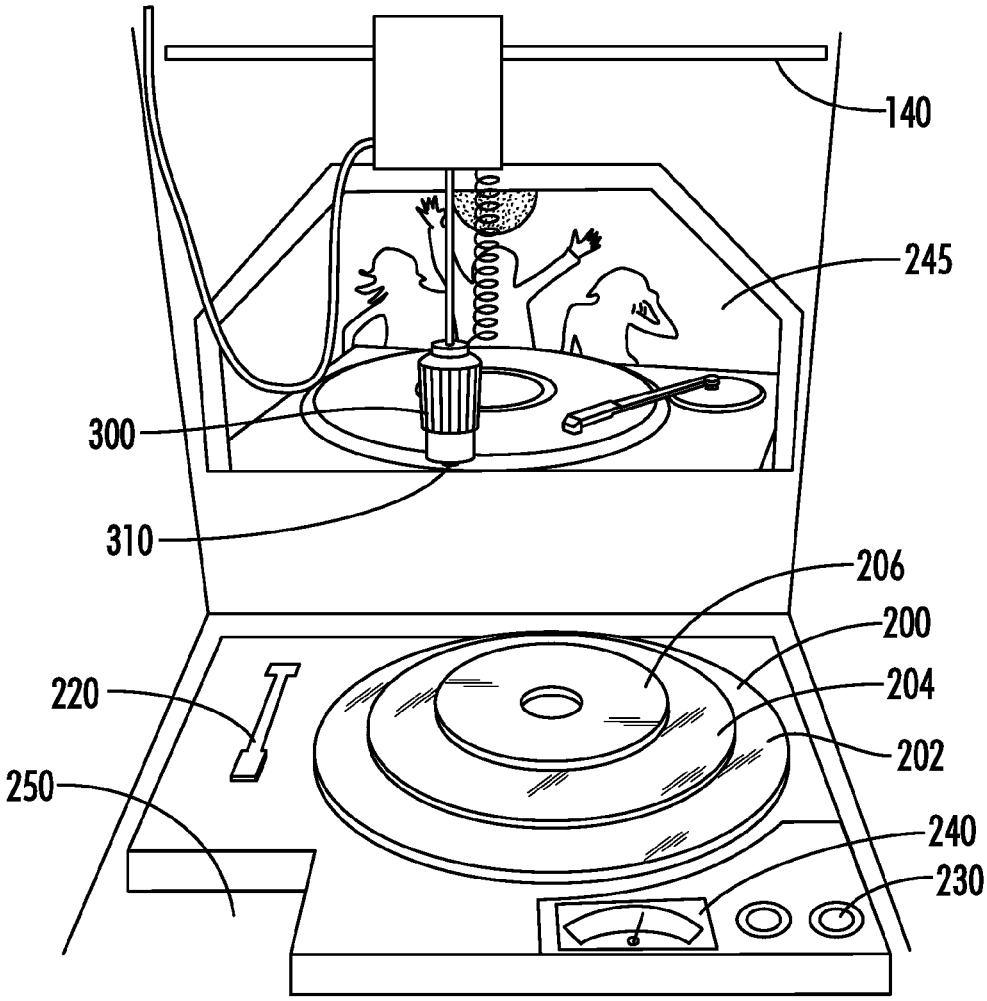
FIG. 2 is one embodiment a game environment illustrating one aspect of the invention.
Figure 3:
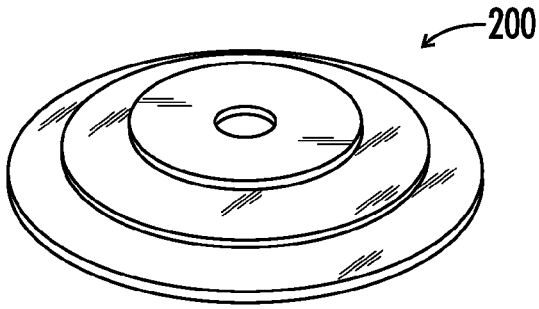
FIG. 3 is a close up view of one embodiment of a rotating field illustrating one aspect of the invention.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Figure 4:
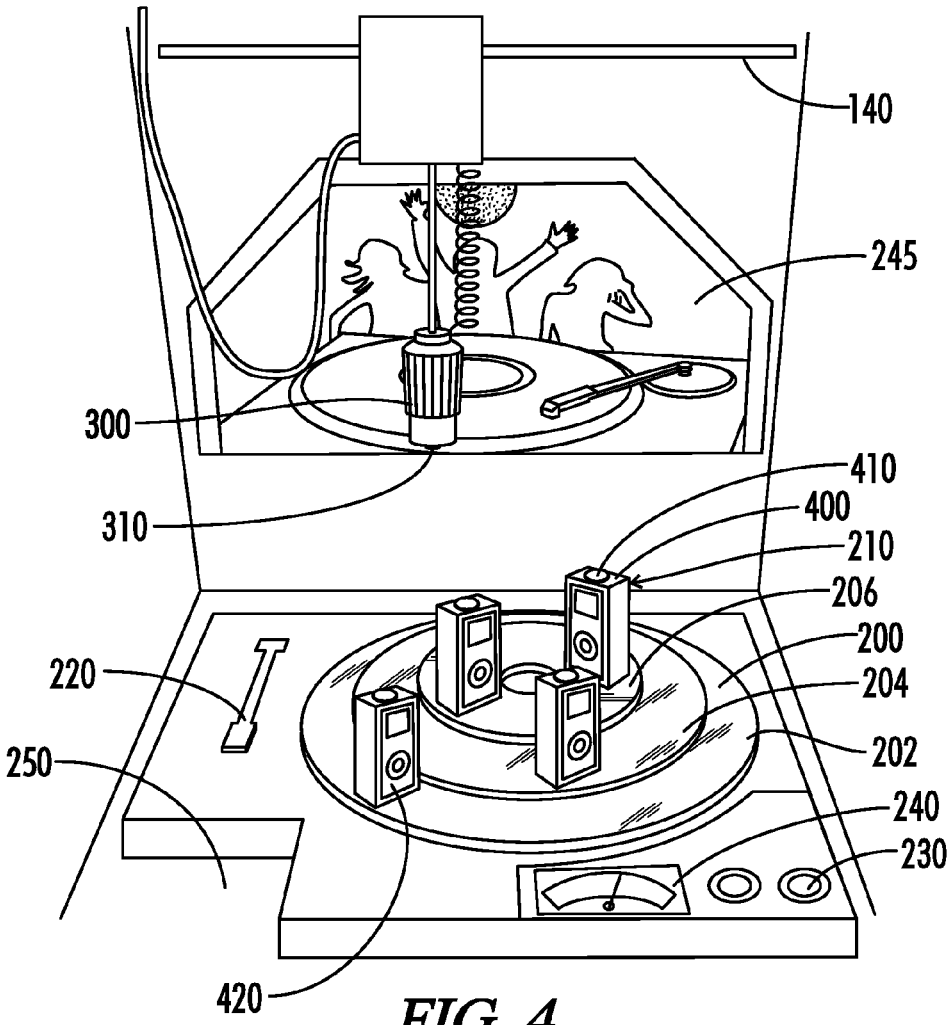
FIGS. 4 through 6 illustrate one embodiment of a game play illustrating one aspect of the invention.

FIG. 1 is one embodiment of a game machine 100 of the type typically enjoyed at amusement parks, arcades, game rooms, bars, night clubs, truck stops, casinos, restaurants and the like and generally includes a field 200 on which is placed one or more objects 210 (FIG. 4) for acquisition by a retriever 300 as will described in more detail below. Other non-limiting venues and environments for the game machine 100 are contemplated. One embodiment of the game machine 100 further comprises a housing 110 having a front 112 with a window, a left side, a right side, and a ceiling with a light. In one embodiment, the housing 110 is predominantly constructed as a plywood cabinet of the type typically seen in arcades, although other materials or combinations of materials are contemplated. The windows are preferably formed from a transparent thermoplastic such as acrylic or Plexiglas, although other materials are contemplated, and are provided to enhance the enjoyment of the game by providing visual access to all aspects of the game from various viewpoints and vantage points relative to housing 110. It is preferred that the window material is strong enough to resist a significant impact force, especially since the game machine is likely to be enjoyed by all ages and in particular children and adolescents that might inadvertently punch, collide with or throw something at a window. It is also preferred that the window material is scratch resistant if possible.

A user access panel 120 is preferably attached to, or otherwise incorporated in the front 112 of the housing 110 and preferably includes a controller 122 such as a joystick having an actuation button 123, a money acceptor 124 such as a coin, token and/or bill acceptor, and an outlet 130 through which is dispenses an object 210 (FIG. 4) that is retrieved as will be described below. The actuation button 123 described in the present embodiment is shown integrally attached to the controller 122, although it will be appreciated that it could be separate from the controller in another location on the panel 120 if desired. In addition, while a joystick controller 122 is illustrated, it will be appreciated that other controller devices may be used, such as a controller actuated by a single button or a plurality of buttons, a computer mouse, a roller ball or track ball, or a combination of controller devices as described or hereinafter developed. Other methods of control and actuation are contemplated. Engagement with the user access panel 120 and operation of the game machine 110 will be described later.

The game environment that is viewable through a variety of windows in the housing 110 as shown in the illustrated embodiment of the game machine 100 is intended to represent a disco theme from the 1970's, for example, and includes a variety of disco-related aesthetics such as music, images of people dancing, a glitter ball, a record player and the like. For purposes of illustration, the imagery in the game will be shown and described in such a disco setting, although it will be appreciated that any type of setting and imagery can be employed as desired by the user and game developer. For example, while a disco scene is shown for purposes of illustration, other non-disco scenes may be utilized including, but not limited to, an Alaskan wilderness scene, a prehistoric scene, a beach scene, an outer space alien scene, or others.

One aspect of the game environment includes a rotating field 200 that is representative of a turntable or a record player of the type that plays record albums. The field 200 is driven by a motor (not shown). While the field is preferably a rotating field 200, the rotation may be continuous, intermittent, unidirectional, bidirectional, or a combination of the same. In addition, the rotation may occur at various times, while the game 100 is being played, and/or during periods of non-play to further illustrate the game to potential players. In one embodiment, the field 200 further comprises a three-dimensional tiered surface that is preferably mirrored and that accommodates a plurality of objects 210 at different height levels 202, 204 and 206 (FIG. 4), where the value of the objects 210 may be the same or may differ with the field level. While three levels 202, 204 and 206 are described, it will be appreciated that a different number of levels are possible. For example, objects of greater value may be on the lowest level 202, or farthest away from the retriever 300 as will be described below, and objects of lesser value may reside on the higher levels 204 and 206 or the levels closer to the retriever 300, or vice versa. Or the objects may all have the same value, or randomly have different values. In another embodiment, the field further comprises a two-dimensional surface that accommodates a plurality of objects 210 at the same level. The objects 210 in general further comprises prizes 420 that are preferably high-value, desirable objects such as personal music players, personal digital assistants, lighters, cell phones, etc., which is more typical of a skill-based game requiring capture of individually-arranged objects, as opposed to a claw game with a field of stacked plush animals or the like. The field 200 is preferably surrounded by illustrations indicative of a turntable, such as record arm 220, switches 230 and a level indicator 240. Above the field 200 is an image 245 of a turntable that is similar in appearance to the image of the field 200, where the image 245 is preferably a two-dimensional representation of the three-dimensional field 200.

Another aspect of the game 100 includes the use of a retriever 300 that, in the illustrated embodiment, assumes the image of a disco ball that is intended to be used to retrieve one of the objects 210 (FIG. 4) from the field 200. More specifically, the retriever 300 preferably includes a plurality of circumferentially-arranged, vertically-oriented panels 305 that illuminate and/or flash intermittently and/or in accordance with music being played during the game. While vertically oriented panels 305 are shown, it will be appreciated that other arrangements and variations thereof are possible to create a visually stimulating aesthetic for the retriever 300. Thus, in the disco theme embodiment shown and described herein, the retriever 300 is reminiscent of a disco ball that flashes, etc, during the game play. The retriever 300 is guided by the controller 122 along a track 140 supported adjacent the ceiling 150 of the housing 110 by a spaced-apart pair of guide rails 160 extending along the left and right sides of the housing 110 for enabling movement of the retriever 300 along the width of the housing 110, the guide rails 160 enabling movement of the retriever 300 along the depth of the housing 110 between the front and the back of the housing 110.

In a preferred embodiment, the retriever 300 acquires objects 210 (FIG. 4) through the use of magnetic attraction. Specifically, the retriever 300 is provided with a magnet 310, or the retriever 300 is otherwise magnetized such as with an electromagnet or the like (not shown), such that when the retriever is positioned adjacent an object 210 on the field 200, the object 210 will be retrieved or captured by the retriever 300. In this regard, it is preferred that at least one, and preferably all of the objects 210 have material properties that are somehow responsive to a magnetic field. In one aspect of the invention, an object 210 includes a prize 420 that is housed within a protective case 400 that is provided with a magnetic top 410 that is adapted to be acquired by the retriever 300 or retriever magnet 310. Thus, one aspect of the material forming an object or a protective case for an object could be ferromagnetic or ferromagnetic such as iron, nickel, cobalt and various alloys, which are attracted to a magnet. Such material would allow for capture and retrieval of an object 210 by the retriever 300. All of the objects 210 positioned on the field 200 could be the same or different as desired.

Figure 5:
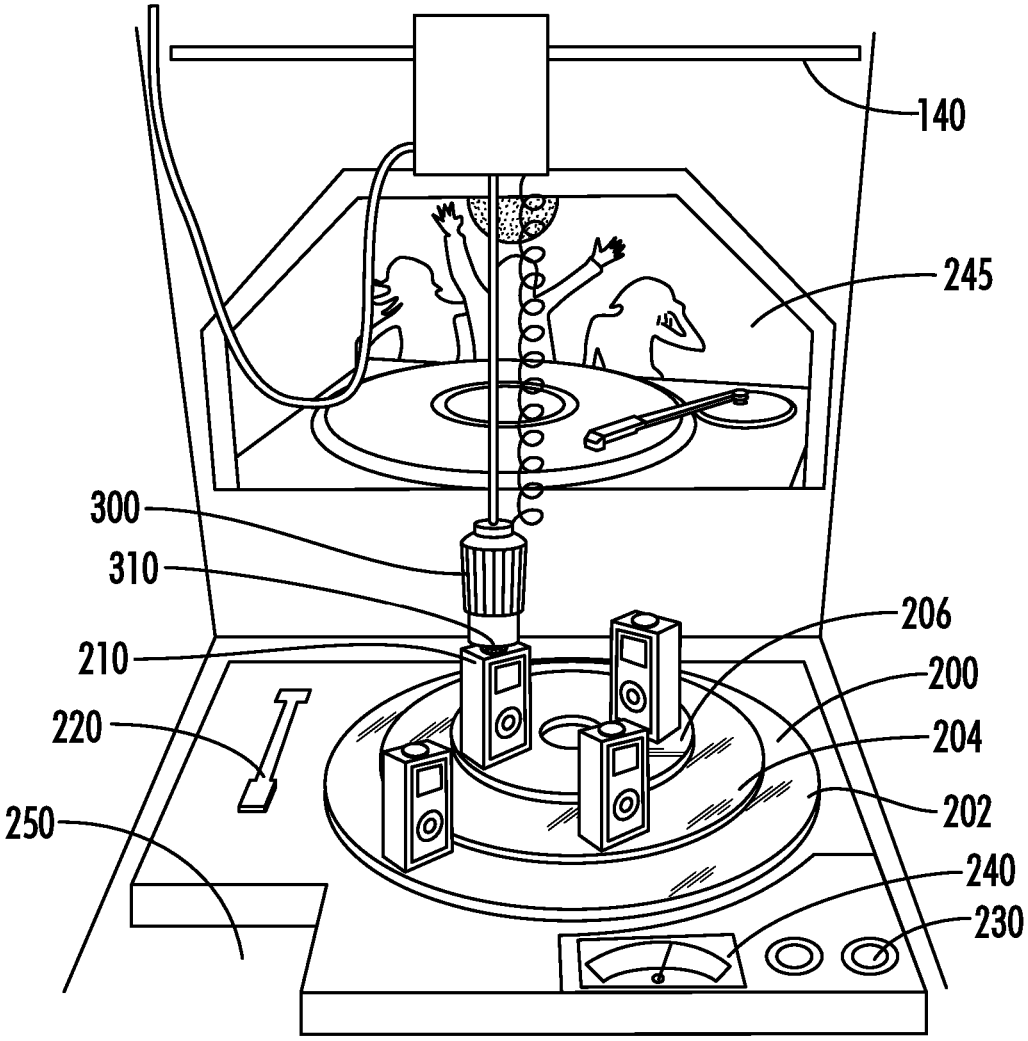
Figure 6:
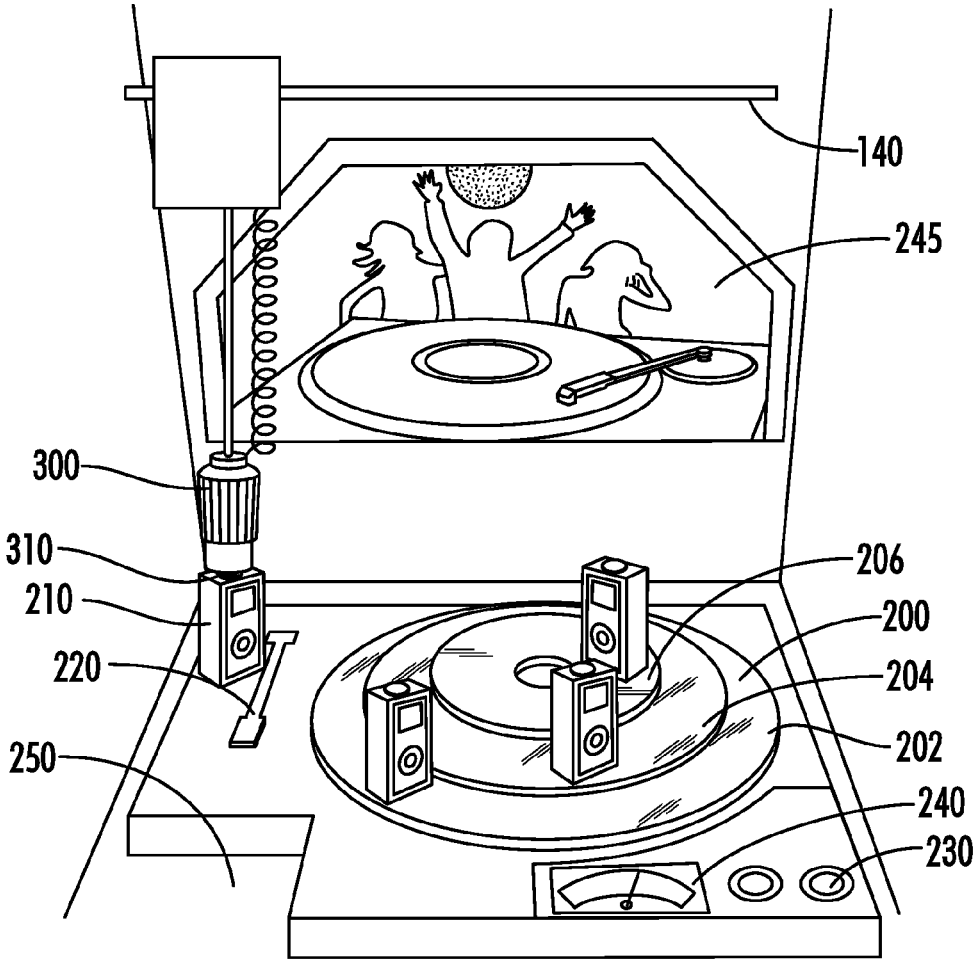

Once the retriever 300 acquires an object 210 from the field 200 (FIG. 5), it delivers the object 210 to an object receiving area 250 (FIG. 6) that is in communication with the outlet 130 through which the object is delivered to the player (not shown) of the game. In one embodiment, the player receives the protective case 400 with the prize 420 inside and discards the case 400 after removing the prize 420. In an alternative embodiment, there is provided a receptacle of some kind (not shown), either associated with the housing 110 or located adjacent thereto, that receives discarded cases 400 to be recycled later with different prizes. The return of the retriever 300 from the field 200 to the object receiving area 250 can occur automatically upon acquisition of an object 210 by the retriever 300 and/or retriever magnet 310, or it can occur manually with the use of the controller 122 or the like.

A player (not shown) activates the game by inserting some form of payment, such as coins, tokens, bills, credit cards, point cards or the like into the payment acceptor 124. Using the controller 122, the player moves the retriever 300 into position above the field 200 and above the objects 210 and then the player drops the retriever 300 toward the field 200 using the button 123 on the controller 122 or a separate button (not shown) on the user access panel 120 until the magnet 310 on the retriever 300 engages an object 210 on the field 200, and in the embodiment described herein the magnetic top 410 of the case 400. The field 200 preferably stops rotating upon a player's engagement with the activation button 123. If the magnet 310 successfully engages and acquires an object 210 (FIG. 5), the object 210 will rise with the retriever 300 and be delivered to the object receiving area 250 (FIG. 6) and then dropped toward the outlet 130 and delivered to the player. If the magnet 310 does not successfully engage an object 210, the retriever 300 will rise from the field 200 and return to its original position until it is activated again. During the game, the player is presented with aesthetically exiting images of a disco theme, with sound effects, light effects and movement effects.

It should be apparent to one of ordinary skill in the art that a control system used herein to control the various aspects of the game can be implemented in hardware, software, firmware, or any combination thereof. Moreover, the software is preferably implemented as an application program tangibly embodied on a program storage unit or computer readable medium. The application program may be uploaded to, and executed by, a machine comprising any suitable architecture. Preferably, the machine is implemented on a computer platform having hardware such as one or more central processing units ("CPUs"), a memory, and input/output interfaces. The computer platform may also include an operating system and microinstruction code. The various processes and functions described herein may be either part of the microinstruction code or part of the application program, or any combination thereof, which may be executed by a CPU, either in the game unit or remote from the game unit, whether or not such computer or processor is explicitly shown. In addition, various other peripheral units may be connected to the computer platform such as additional data storage units and communications devices.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A game machine comprising:

a) a housing;

b) a user access panel having a controller;

c) a rotating field having a surface for receiving a plurality of objects thereon;

d) a retriever that is movable along a track that is supported by the housing for enabling movement of the retriever relative to the rotating field;

e) an object receiving area; and f) an outlet for access to an object received within the object receiving area; and wherein the surface is a tiered, mirrored surface.

2. The game machine of claim 1, wherein the controller is a joystick with an integrated activation button.

3. The game machine of claim 1, further comprising a spinning disco ball attached to the housing.

4. The game machine of claim 1, wherein the retriever includes a magnet or is magnetized, and at least one of the plurality of objects is capable of being magnetically retrieved by the retriever.

5. The game machine of claim 1, wherein the at least one object is formed from ferromagnetic or ferromagnetic material.

6. The game machine of claim 1, wherein the rotating field rotates in a unidirectional manner, a bidirectional manner, or in a combination of the two.

7. The game machine of claim 1, wherein the rotating field rotates continuously, intermittently, or in a combination of the two.

8. The game machine of claim 1, further comprising a processor connected to a network for remote operation or maintenance of the game machine.

9. The game machine of claim 1, wherein the retriever further comprises a disco ball circumferentially-arranged on the retriever.

10. A game machine comprising:

a) a housing;

b) a user access panel having a controller;

c) a rotating field having a surface for receiving a plurality of objects thereon;

d) a retriever that is movable along a track that is supported by the housing for enabling movement of the retriever relative to the rotating field;

e) an object receiving area; and f) an outlet for access to an object received within the object receiving area;

and wherein the surface is illustrative of a record player.

11. The game machine of claim 10, further comprising a graphical image of a record player above the rotating field.

12. The game machine of claim 11, further comprising a graphical image of components of a record player around the rotating field.

13. A game machine comprising:

a) a housing;

b) a controller;

c) a rotating field having a three-dimensional, tiered, multi-level surface for receiving a plurality of objects thereon;

d) a retriever that is movable along a track that is supported by the housing for enabling movement of the retriever relative to the rotating field, wherein the retriever includes a magnet or is magnetized, and at least one of the plurality of objects is capable of being magnetically retrieved by the retriever;

e) an environment above the field that includes a graphical image that mimics the appearance of the rotating field;

f) an object receiving area for receiving objects retrieved by the retriever; and g) an outlet for access to an object received within the object receiving area.

14. The game machine of claim 13, wherein the retriever further comprises a plurality of circumferentially-arranged, vertically-oriented panels that illuminate.

15. The game machine of claim 14, wherein the surface is a mirrored surface.

16. The game machine of claim 15, wherein each object has a value that is dependent on a level of the tiered surface on which the object is placed.

17. The game machine of claim 16, wherein the surface is illustrative of a record player.

18. The game machine of claim 17, further comprising a graphical image of a record player above the rotating field.

* * * * *